US006076438A

United States Patent [19]

Rahm

[11] Patent Number: 6,076,438

[45] **Date of Patent: *Jun. 20, 2000**

[54] POWER NUTRUNNER WITH TORQUE RELEASE CLUTCH AND A SETTING TOOL

[75] Inventor: Erik Roland Rahm, Väsby, Sweden

[73] Assignee: Atlas Copco Tools AB, Nacka, Sweden

[ * ] Notice: This patent is subject to a terminal disclaimer.

[21] Appl. No.: 09/142,616

[22] PCT Filed: Mar. 11, 1997

[86] PCT No.: PCT/SE97/00409

§ 371 Date: Sep. 10, 1998

§ 102(e) Date: Sep. 10, 1998

[87] PCT Pub. No.: WO97/33722

PCT Pub. Date: Sep. 18, 1997

[30] Foreign Application Priority Data

Mar. 11, 1996 [SE] Sweden ..... 9600934

[51] Int. Cl.[7] ..... B25B 23/157

[52] U.S. Cl. ..... 81/473; 173/176

[58] Field of Search ..... 81/57.14, 473, 81/474, 475; 173/176, 178

[56] References Cited

U.S. PATENT DOCUMENTS

| | | | |
|---|---|---|---|
| 4,084,487 | 4/1978 | Wallace . | |
| 4,898,249 | 2/1990 | Ohmori | 81/473 X |
| 5,076,120 | 12/1991 | Lin | 81/473 X |

FOREIGN PATENT DOCUMENTS 1 087 540 8/1960 Germany .

*Primary Examiner*—James G. Smith
*Attorney, Agent, or Firm*—Frishauf, Holtz, Goodman, Langer & Chick, P.C.

[57] ABSTRACT

A power nutrunner includes a planetary reduction gearing (12) and a torque limiting release clutch (13) disposed between a ring gear (25) of the reduction gearing (12) and the tool housing (11), wherein the ring gear (25) is tubular in shape and has an outer annular shoulder (41) at its one end carrying cam teeth (42) for cooperation with a spring biased thrust element (45) via balls (43) and cam surfaces (44). The thrust element (45) encircles the ring gear (25) and is biased by a pretensioned spring (53) which is backed by an adjustable support (52) including a rotatable screw element (70) connected to the housing (11) and provided with gear teeth (74) to be engaged by a setting tool (80) inserted through a front opening (79) in the housing (11).

9 Claims, 2 Drawing Sheets

POWER NUTRUNNER WITH TORQUE RELEASE CLUTCH AND A SETTING TOOL

BACKGROUND OF THE INVENTION

This invention relates to a power nutrunner of the type having an adjustable torque release clutch.

In particular, the invention concerns a power nutrunner which comprises a planetary reduction gearing with a ring gear, and a torque release clutch associated with the ring gear, wherein the release clutch includes a thrust element, a cam means, and a pretensioned spring acting between a spring support means movably supported in the housing and the thrust element for exerting an adjustable release point determining bias load on the cam means.

A power nutrunner of this type is previously known through U.S. Pat. No. 4,084,487. The pretension level of the clutch biassing spring of this power tool is adjustable by a ring nut which engages an external thread on the tool housing. This ring nut is normally covered by a protective exhaust deflector sleeve, and setting of the clutch spring pretension level is rather awkward, since the protective sleeve has to be released and slid aside to get access to the ring nut. This prior art spring support design is disadvantageous also in that it adds to the outer dimensions of the nutrunner housing.

The main object of the invention is to provide a power nutrunner of the above described type, wherein the clutch spring support means is compact in design, easily accessible by means of a setting tool without dismantling any tool parts, and still well protected against unintentional displacement.

Another object of the invention is to provide a setting tool specially adapted for the adjustable clutch spring support means having the specific features of the invention.

Further objects and advantages of the invention will appear from the following specification and claims.

A preferred embodiment of the invention is below described in detail with reference to the accompanying drawing figures.

DETAILED DESCRIPTION

Figure 1:
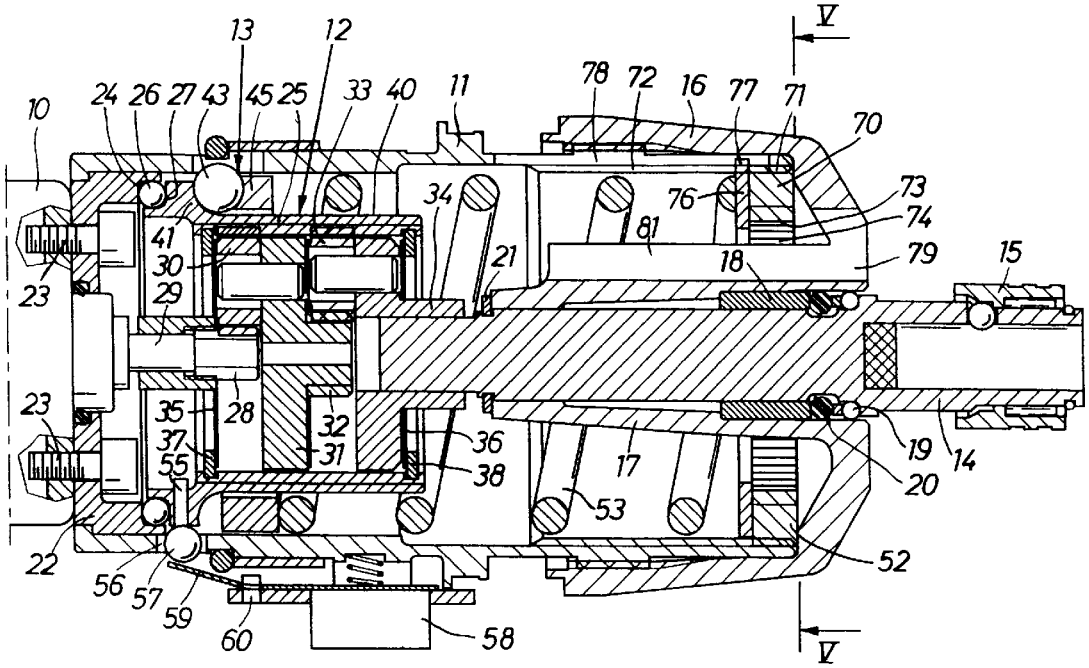
FIG. 1 shows a longitudinal section through the front part of a power nutrunner according to the invention.

The nutrunner illustrated in the drawing figures comprises a motor unit 10 the forward end portion only of which is shown in FIG. 1. Since the motor unit 10 does not form any part of the invention a detailed description thereof is not needed and is, therefore, left out of this specification.

To the motor unit 10 there is bolted a housing 11 for a reduction gearing 12 and a torque limiting release clutch 13. An output spindle 14 is connected to the motor unit 10 via the reduction gearing 12 and is provided with a chuck 15 for attachment of a screw joint engaging tool implement. At this forward end, the housing 11 is provided with an end wall 16 in which the output spindle 14 is rotationally journalled. The end wall 16 is formed with an internal neck portion 17 for providing a proper guidance for the output spindle 14. A bushing 18 at the front end of the end wall 16 defines a central bore in the end wall 16 and forms a bearing for the output spindle 14. The bushing 18 is formed with an annular shoulder for transferring axial forces from the spindle 14 to the housing 11. A lock ring 19 and a shock absorbing resilient ring 20 are mounted on the spindle 14 for engagement with the shoulder of the bushing 18. In the opposite direction, the spindle 14 is axially locked by a lock ring 21 cooperating with the inner end of the end wall neck portion 17.

The rear end of the housing 11 comprises an end wall 22 which is secured to the motor unit 10 by means of screws 23. The end wall 22 is formed with a ball race 24 for rotational support of a tubular ring gear 25 via a number of balls 26 in cooperation with a ball race 27 on the ring gear 25.

The reduction gearing 12 comprises two consecutive planetary gearings for which the ring gear 25 is a common member. The planetary gearings comprise a sun gear 28 attached to the motor unit output shaft 29, a first set of planet wheels 30, a planet wheel carrier 31 formed integrally with a second sun gear 32, a second set of planet wheels 33, and a second planet wheel carrier 34 connected to the output spindle 14. The planetary gearings are axially confined between two end washers 35, 36 supported by two lock rings 37, 38 secured to the ring gear 25.

Figure 3:
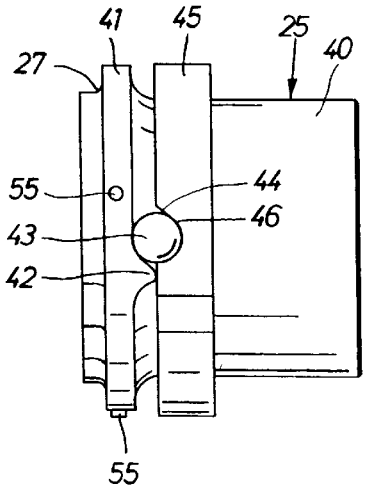
FIG. 3 shows a side elevation of the release clutch included in the power nutrunner shown in FIG. 1.
Figure 2:
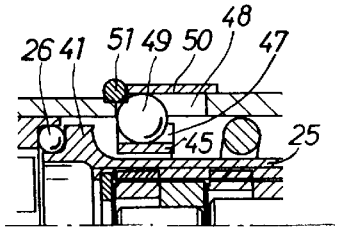
FIG. 2 shows a fractional section through the power nutrunner shown in FIG. 1, but located in a different plane.
Figure 4:
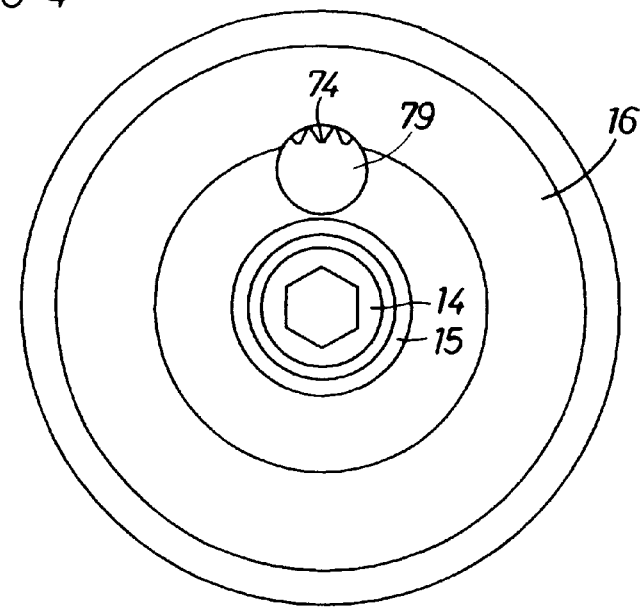
FIG. 4 shows a front end view of the nutrunner in FIG. 1.

The ring gear 25 is substantially tubular in shape and has an outer cylindrical surface 40 and an annular shoulder 41. See FIG. 3. This shoulder 41 is provided with three axially directed and equally spaced cam teeth 42 which together with three balls 43 and three corresponding cam surfaces 44 on an annular thrust element 45 form the torque transferring clutch 13. These cam surfaces 44 are formed by three indentations 46 in the rear annular end surface of the thrust element 45. See FIG. 3.

The thrust element 45 is axially movable in the housing 11 but locked against rotation by means of a ball spline connection. The latter comprises three axially directed grooves 47 disposed on the outside of the thrust element 45, three slots 48 in the housing 11, and three balls 49 engaging the grooves 47 and the slots 48. A circular band 50 on the outside of the housing 11 retained by a lock ring 51 covers the slots 48, thereby preventing the balls 48 from falling out. The balls 49 are inserted from the outside of the housing 11 after removal of the lock ring 51 and sliding aside the band 50.

As illustrated in the drawing figures, the thrust element 45 has a larger diameter than the outer cylindrical surface 40 and encircles the latter. Accordingly, the thrust element 45 is located outside the ring gear 25 as is the rear end portion of a compression spring 53 which acts between the thrust element 45 and an adjustable support member 52 at the front end of the housing 11. The force developed by the spring 53 on the thrust element 45 exerts a bias load on the release clutch 13. This adjustable bias load together with the very shapes of the cam surfaces 44 and cam teeth 42 are determining for the torque level where the clutch releases.

At its rear periphery, the ring gear 25 is provided with three radially extending pins 55 disposes at equal angular distances from each other. In an aperture 56 in the housing 11 there is movably supported a ball 57, and on the outside of the housing 11 there is mounted a signal producing micro switch 58. A level 59 pivoted about a stud 60 is arranged to transfer an activation movement from the ball 57 to the micro switch 58.

The micro switch 58 is connected to electronic control means for controlling the operation of the tool. These control means do not form any part of this invention and is, therefore, not described any further in this specification.

The adjustable spring support member 52 comprises an annular screw element 70 formed with an outer thread 71 for engagement with an internal thread 72 in the housing 11. The screw element 70 is also formed with a concentric opening 73 provided gear teeth 74.

A contact member in the form of an annular washer 76 is located between the spring 53 and the screw element 70. This washer 76 is provided with a radially extending dog 77 which is arranged to guidingly cooperate with an axially extending slot or groove 78 in the housing 11. Thereby, the washer 76 is locked against rotation but axially displaceable in the housing 11. The washer 76 is intended to prevent torsional friction forces from being transferred from the screw element 70 to the spring 53 at rotation of the screw element 70.

The inner diameter of the washer 76 is smaller than the diameter of the opening 73 of the screw element 70, whereby the washer 76 forms an axial abutment means for the setting tool 80 as will be described below.

Figure 5:
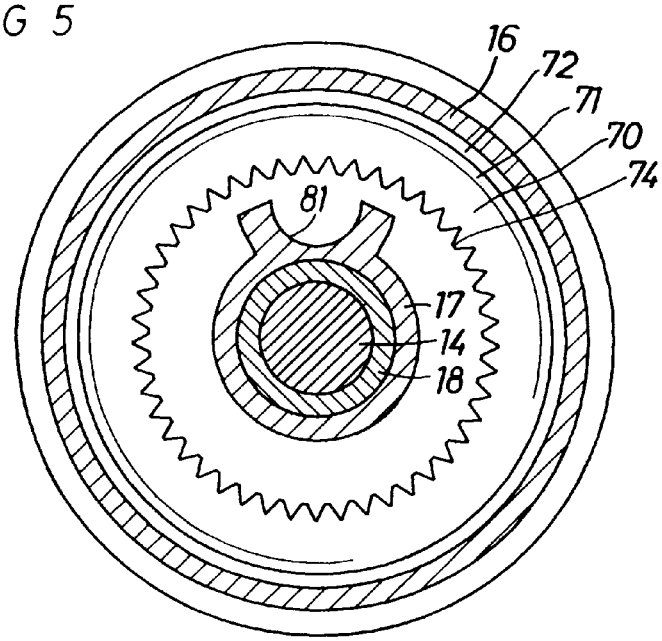
FIG. 5 shows a cross section along line V—V in FIG. 1.

In the front end wall 16 there is provided an opening 79 which is directed axially in parallel with the output spindle 14. The opening 79 is intended to receive a setting tool 80 for engagement with and adjustment of the screw element 70. For accomplishing a proper guidance of the setting tool 80 during clutch adjusting operations, the internal neck portion 17 of the end wall 16 is formed with a part-cylindrical open groove 81 extending in parallel with the output spindle 14. See FIG. 5.

Figure 6:
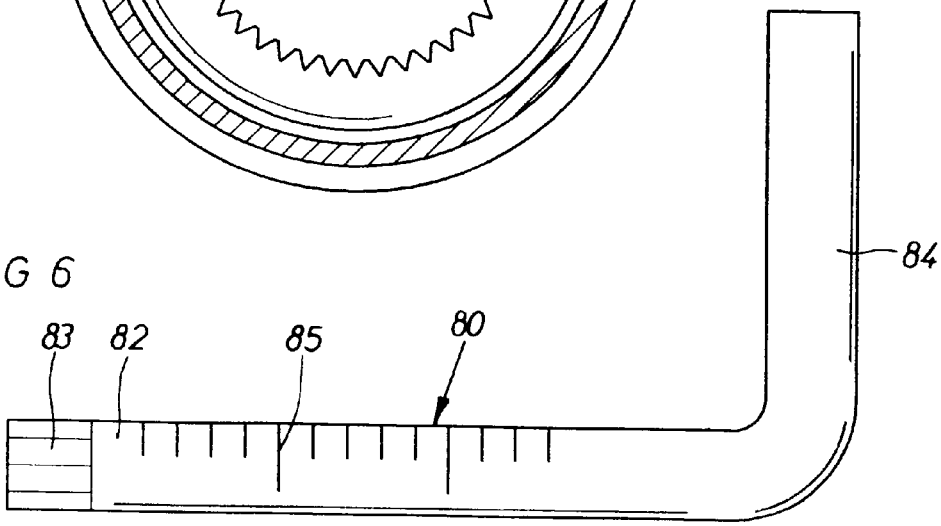
FIG. 6 shows a side elevation of a setting tool according to the invention.

The setting tool 80, as illustrated in FIG. 6, comprises a cylindrical spindle portion 82 which at its forward end is provided with external gear teeth 83 for engagement with the gear teeth 74 of the screw element 70. At its rear end, the setting tool 80 is formed with a handle 84 for manual operation. On the spindle portion 82 there is provided a scale 85 which is readable against the edge of the opening 79. The scale 85 is graduated in Nm (Newton meters) and informs of the actual setting of the spring support member 52, i.e. the actual release torque level of the clutch 13.

The clutch setting is proportional to the axial position of the spring support 52 and, accordingly, to the penetration depth of the setting tool 80. The penetration depth of the setting tool 80 is defined in relation to the end of the spring 53 by means of by the washer 76. The latter forms a stop means to be engaged by the forward end of the spindle portion 82 as the tool 80 is inserted through the opening 79 and occupies its proper operating position.

In operation of the nutrunner, the output spindle 14 is connected to a screw joint to be tightened via the chuck 15 and a tool implement attached thereto. Rotation power is supplied from the motor unit 10 via the shaft 29, and a speed reduction is obtained by the two consecutive planetary gearings before the rotation power reaches the output spindle 14.

As the torque resistance from the screw joint increases, the reaction torque from the planetary gearings increases on the ring gear 25. This means that the ring gear 25 tends to start rotating, but is prevented from that by the clutch 13. The ring gear 25 remains stationary and the clutch continues to transfer the reaction torque from the ring gear 25 to the housing 11 as long as the bias load of the spring 53 is able to prevent the thrust element 45 from moving axially as a result of the interaction of the cam teeth 42, the balls 43 and cam surfaces 44.

As the intended release torque level of the clutch 13 is reached, however, the spring 53 yields to a point where the cam teeth 42 are able to pass over the balls 43 and the ring gear 25 is free to rotate relative to the thrust element 45 and the housing 11. The balls 43 remain in the indentations 46 in the thrust element 45 during the relative rotation between the ring gear 25 during the relative rotation between the ring gear 25 and the thrust element 45.

At rotation of the ring gear 25, at release point of the clutch 13, one of the pins 55 comes into engagement with the ball 57 to move the latter outwardly. This activation movement is transferred via the lever 59 to the micro switch 58 which delivers an electric signal to a control means for accomplishing shut-off of the nutrunner motor.

Each of the pins 55 is so located in relation to the cam teeth 42 that an activation of the micro switch 58 via the ball 57 and the lever 59 does not take place until the teeth 42 have reached or just passed the top of the balls 43, i.e. when the torque transfer through the clutch has just ceased.

Depending on the actual rotation speed of the nutrunner motor and the other rotating parts of the tool at the shut-off point, the ring gear 20 continues to rotate some distance before coming to stand still. If the speed is high at the release point of the clutch 13, which is the case at tightening so called stiff screw joints, the ring gear cam teeth 42 will reach and even pass over the next ball engaging position before stopping. Since the motor is shut off at the first release position of the clutch, there is no driving torque to be transferred in the second ball engaging position of the gear ring 20, also is the kinetic energy of the rotating parts substantially decreased, which means that the second clutch engagement, if any, does not cause any torque overshoot.

When the release torque level of the clutch 13 is to be changed, the setting tool 80 is inserted through the front opening 79, whereby an engagement is obtained between the gear teeth 83 on the setting tool 80 and the gear teeth 74 in the screw element 70. The proper operating position of the setting tool 80 is defined by abutment of the forward end of the setting tool against the washer 76. Rotation of the setting tool 80 causes rotation of the screw element 70, and due to the thread engagement between the screw element 70 and the housing 11 the spring support 52 will be displaced in the desired direction to change the pretension level of the spring 53.

The above described nutrunner is intended to be powered by an electric motor with the micro switch connected to a motor voltage controlling means of any suitable kind. In particular, the invention is suitable for application on a battery powered nutrunner. In such a case, the motor control means is located on-board the tool.

However, the invention is not limited to a nutrunner having an electric motor, but could as well be applied on a nutrunner having a pneumatic motor. In such a case, the micro switch is connected to an external electric control unit by which a pressure air supply valve is controlled so as to obtain a timely shut-off of the motor at release of the clutch 13.

What is claimed is:

1. A power nutrunner, comprising:

a housing (11);

an output spindle (14) connectable to a screw joint to be tightened;

a planetary reduction gearing (12) including a ring gear (25) rotatably supported in said housing (11); and an output torque limiting release clutch (13) associated with said ring gear (25) and including a non-rotatable but axially displaceable thrust element (45), a cam (42, 44) disposed between said ring gear (25) and said thrust element (45), and a pretensioned spring (53) acting on said thrust element (45) for exerting a release point determining bias load on said cam (42, 44), and a spring support (52) movable supported in said housing (11) for providing adjustability of said bias load;

wherein:

said housing (11) is provided with an internal thread (72);

said spring support (52) comprises an annular screw element (70) formed with an external thread (71) for cooperation with said internal thread (72) in said housing (11);

said screw element (70) has a concentric opening (73) provided with internal gear teeth (74); and said housing (11) has an opening (79) directed in parallel with said output spindle (14) for receiving a rotatable setting tool (80) provided with external gear teeth (83) for engagement with said internal gear teeth (74) of said screw element (70) to rotate said screw element (70) and, thereby, adjust the pretension of said spring (53).

2. The power nutrunner according to claim 1, wherein said spring support (52) comprises:

a contact member (76) located between said screw element (70) and said spring (53); and a guide (77, 78) provided between said contact member (76) and said housing (11) for preventing rotation while permitting axial displacement of said contact member (76) relative to said housing (11), thereby preventing torsional friction forces from being transferred from said screw element (70) to said spring (53) at rotation of said element (70).

3. The power nutrunner according to claim 2, wherein said guide (77, 78) comprises:

at least one radially extending dog (77) on said contact member (76); and at least one axially extending groove (78) in said housing (11) for guidingly receiving said at least one dog (77).

4. The power nutrunner according to claim 1, wherein:

said housing (11) has a front end wall (16) formed with a central bore (18) for penetration of said output spindle (14); and said opening (79) extends through said end wall (16) in parallel with said central bore (18).

5. The power nutrunner according to claim 4, wherein:

said end wall (16) comprises a concentric inwardly extending neck portion (17); and said neck portion (17) has an open axially directed part-cylindrical groove (81) located in alignment with said opening (79) for guidance of said setting tool (80) as the setting tool is inserted through said opening (79).

6. The power nutrunner according to claim 2, wherein said contact member (76) forms an insertion depth limiting means for said setting tool (80).

7. The power nutrunner according to claim 1, wherein said setting tool comprises:

an elongate spindle portion (82) with a forward end for introduction through said opening (79); and a handle (84) for manual rotation of said spindle portion (82); and wherein said forward end of said spindle portion (82) is formed with external gear teeth (83) arranged to engage said internal gear teeth (74) of said screw element (70).

8. The power nutrunner according to claim 7, wherein:

said spindle portion (82) comprises an introduction depth indicating scale (85) readable against an edge of said opening (79); and wherein variations in the introduction depth of said spindle portion (82) are proportional to variations in the pretension level of said spring (53) as well as to the release torque level of said clutch (13).

9. The power nutrunner according to claim 2, wherein said setting tool comprises:

an elongate spindle portion (82) with a forward end to be introduced through said opening (79); and a handle (84) for manual rotation of said spindle portion (82);

said forward end of said spindle portion (82) comprising external gear teeth (83) for engaging said internal teeth (74) of said screw element (70), and wherein said forward end of said spindle portion (82) is arranged to abut endwise against said contact member (76) when said spindle portion (82) occupies its proper operating position.

* * * * *